United States Patent [19]

Appelbaum

[11] Patent Number: 4,953,371

[45] Date of Patent: Sep. 4, 1990

[54] SHACKLELESS PADLOCK

[76] Inventor: Paul Appelbaum, 2125 S. Ammons St., Lakewood, Colo. 80227

[21] Appl. No.: 448,219

[22] Filed: Dec. 11, 1989

[51] Int. Cl.[5] ..... F05B 67/36

[52] U.S. Cl. ..... 70/32; 70/38 R; 70/53; 70/417

[58] Field of Search ..... 70/3, 6, DIG. 65, 31, 70/32, 52–56, 417, 38 R, 38 A, 38 B, 38 C, 39

[56] References Cited

U.S. PATENT DOCUMENTS

| | | | |
|---|---|---|---|
| 869,475 | 10/1907 | Bardwell | 70/52 |
| 1,490,453 | 4/1924 | Caldwell | 70/52 |
| 1,566,473 | 12/1925 | Gibson | 70/52 |
| 1,688,187 | 10/1928 | Jackson et al. | 70/52 |
| 2,541,638 | 2/1951 | Clevett | 70/56 |
| 3,636,739 | 1/1972 | Smedley | 70/39 |
| 3,754,419 | 8/1973 | Taylor | 70/52 |
| 3,835,675 | 9/1974 | Lippisch | 70/38 A |
| 3,858,923 | 1/1975 | Bunn | 70/52 X |
| 4,112,716 | 9/1978 | Wippich | 70/52 X |

FOREIGN PATENT DOCUMENTS

| | | | |
|---|---|---|---|
| 810961 | 8/1951 | Fed. Rep. of Germany | 70/38 R |
| 271582 | 2/1951 | Switzerland | 70/32 |

*Primary Examiner*—Lloyd A. Gall
*Attorney, Agent, or Firm*—Charles C. Corbin

[57] ABSTRACT

An improved padlock having a main, generally rectangular case with walls that enclose a locking mechanism, and including a top wall with at least one shaft-receiving bore, and the case having side wall portions that extend upwardly beyond the case top wall and surround the at least one bore, and the top wall having a portion that is shaped for grasping. A latching head is disposed above the main case to which it is connected by at least one shaft extending from the latching head through the at least one bore for lockable engagement with the locking mechanism. The upwardly extending wall portions of the case slidably embrace the outer surface of the latching head to shield the at least one shaft and to guide the latching head in limited vertical movement from a padlock open position, in which a shaped portion of the latching head lower wall is spaced apart from the shaped portion of the case top wall, to a locked position in which these shaped portions are brought together. An opening in the case side wall allows for insertion of an article to be secured, such as a latch member having an end portion that is adapted to be lockably engaged by the aforementioned shaped portions.

3 Claims, 4 Drawing Sheets

SHACKLELESS PADLOCK

BACKGROUND OF THE INVENTION

1. Field of the Invention:

The present invention relates generally to padlocks, and more particularly to padlocks that do not employ conventional U-shaped shackles.

2. Description of the Prior Art:

Most conventional padlocks include a lockable, inverted U-shaped shackle, which component is normally engaged through an opening in an article to be secured, such as the loop of a latch, or an end loop in a latching cable, etc. One fundamental drawback of such conventional designs is that the shackle, in its locked condition, remains accessible to cutting by snipers, shears, and the like. In addition, the fact that a shackle has a small diameter, rod-like configuration helps facilitate the cutting grasp of cutting tools. In order to minimize this limitation, stronger, more expensive metal shackles have been used, however the capabilities of cutting tools have also improved. Another approach to the problem uses a padlock construction designed to partially surround and shield the shackle. While such designs may reduce the accessibility of a shackle to a cutting tool, there remains much room for improvement.

SUMMARY OF THE INVENTION

In view of the foregoing, it is a general object of the present invention to provide a padlock with increased security.

Another object of the invention is to provide a padlock with an article-engaging component that does not lend itself to breakage by a cutting tool.

A further object is to provide a high security padlock at a modest cost.

Yet another object is to provide a latching system in which the article engaged by the padlock is substantially covered by the body of the lock.

Still another object of the invention is to provide a novel latching system that employs a pin-like latch in conjunction with a shackleless padlock.

These and other objects and advantages are provided by the present invention of an improved security padlock that includes a main case that has a bottom, spaced-apart side walls and an upper wall with at least one shaft-receiving bore therein, and the walls enclosing a locking mechanism. Portions of the main case side walls extend upwardly beyond the case upper wall and surround the at least one bore, and there is a first shaped portion of the case upper wall adapted for engaging a member to be latched.

The device includes a latching head disposed above the main case and connected therewith by at least one vertical shaft fixedly attached to the latching head and extending from the bottom of the latching head into the bore of the main case, where it engages the enclosed locking mechanism for limited vertical movement. The upper wall extensions of the case slidably embrace the outside of the latching head and guide it in vertical movement and protectively surround the at least one shaft. The lower face of the latching head has the device's second shaped portion that is adapted in conjunction with the first shaped portion, to grasp a latching member. The subject padlock has a closed position in which the latching head lies adjacent the upper wall of the main case with the aforementioned first shaped portion contacting the second shaped portion, which position is held by virtue of the at least one shaft being releasably locked within the locking mechanism. When the locking mechanism is released, by use of a key, for example, the invented device can assume an open position in which the first and second shaped portions are spaced apart. An open portion of the upward wall extensions will allow the end of a member to be latched to be inserted between the first and second shaped portions when the device is in open position.

One embodiment of the invention, which may be used to grasp the U-shaped structure of a hasp-type latch, has arcuate grooves in its first and second shaped portions so that the U-shaped structure may be held at either of two fixed orientations at about 90° to each other. Other embodiments according to the present invention lend themselves to a novel latching system that avoids the use of latches with U-shaped structures, and which instead uses a latching member in the form of a pin with a circumferentially grooved tip, or a flat tongue-like member having a hole, to be engaged by the first and second shaped portions of the device.

DETAILED DESCRIPTION OF THE INVENTION

Figure 1:
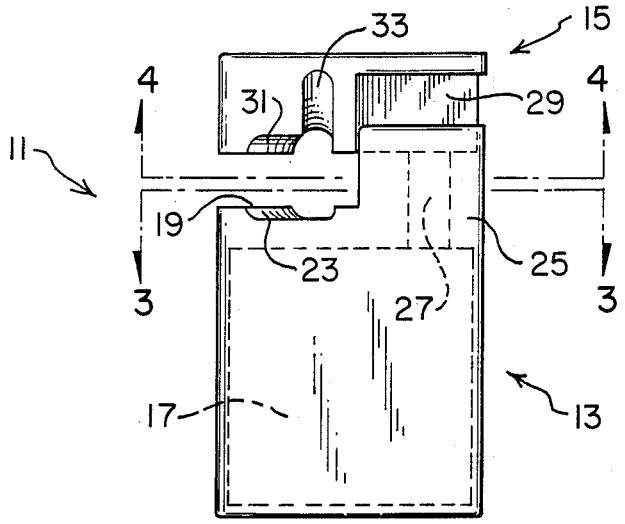
FIG. 1 is a side elevational view of a first embodiment of the shackleless padlock of the invention, in open configuration.
Figure 3:
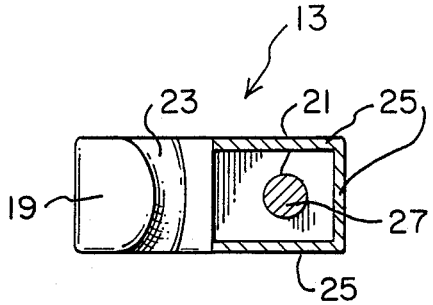
FIG. 3 is a sectional view taken along the line 3—3 of FIG. 1.

Referring now to the drawings, FIG. 1 illustrates that a first embodiment of a novel padlock 11, according to the present invention, includes a main case 13 and a latch head 15. Main case 13 has spaced apart steel sidewalls within which is affixed locking mechanism 17, which is essentially a conventional padlock case, and the bottom wall of main case 13 has an opening, not shown, that provides access to a keyway in the bottom of locking mechanism 17. The main case 13 features an upper wall 19, also shown in FIG. 3, that is equipped with a bore 21 which gives access to the locking mechanism 17, and an arcuate groove 23. FIGS. 1 and 3 also show that the main case 13 also features wall portions 25 that extend upwardly beyond the upper wall 19 so as to substantially surround the bore 21.

Figure 4:
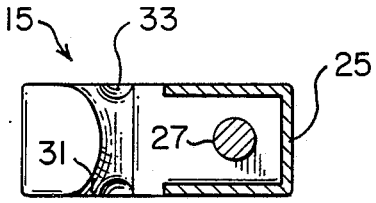
FIG. 4 is a sectional view taken along the line 4—4 of FIG. 1.

As shown in FIGS. 1 and 4 the latch head 15 is connected to the main case 13 by a shaft 27 with its upper end firmly affixed within the body of the latch head 15 and its lower end received via bore 21 within locking mechanism 17, in much the same way as the lower end of a conventional shackle is lockably received within a padlock case. Note that latch head 15 is provided with a recessed surface 29 which is slidably embraced by the inside of the wall portions 25 which will serve to hold the latch head 15 in proper alignment relative to the main case upper wall 19, and to guide vertical movement of the latch head 15 in a manner to be described. The other side of latch head 15 is provided with a first arcuate groove 31 which is aligned above and complements the arcuate groove 23 of the main case upper wall 19. Head 15 has a second arcuate groove 33 which is aligned at roughly 90° to the first groove 31.

Figure 2:
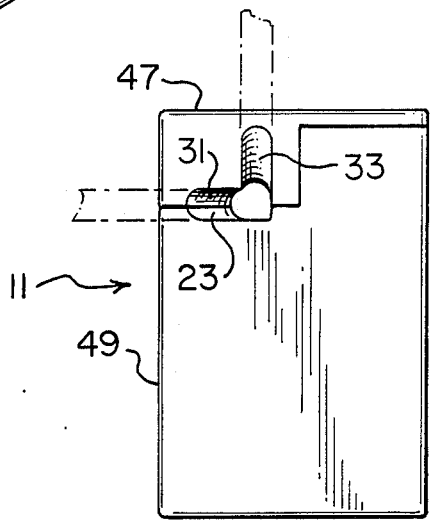
FIG. 2 is a side elevational view showing the embodiment of FIG. 1 in closed configuration.

When the locking mechanism 17 is in unlocked condition the lock 11 will have the open configuration shown in FIG. 1 where the head 15 is held spaced a certain distance above the case upper wall 19 with the shaft 21 being urged to this upward position by spring means within mechanism 17. Lock 11 may be moved to its closed configuration illustrated in FIG. 2, when the head 15 is urged downwardly to that position and a lower end of shaft 21 locks within mechanism 17, in much the same manner as the shackle of a conventional padlock will lock.

Figure 5:
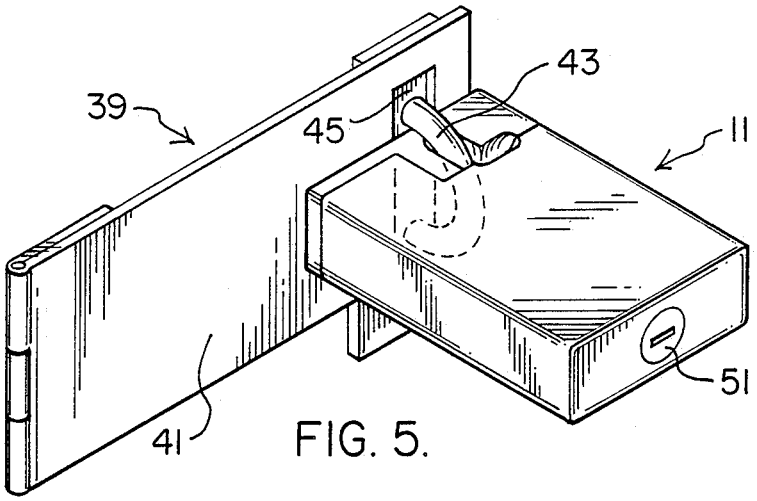
FIG. 5 is a prospective view showing a first orientation in which the padlock of FIG. 1 can be applied to the loop of a hasp-type latch.
Figure 6:
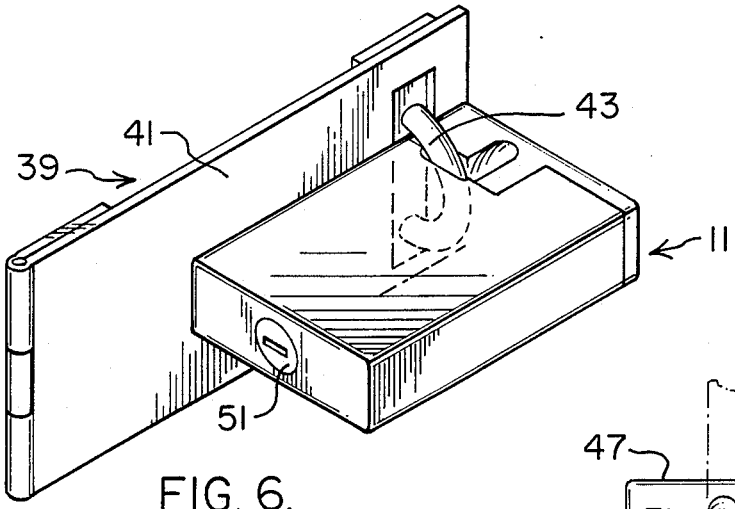
FIG. 6 a prospective view showing a second orientation in which the padlock of the invention can be applied to a hasp-type latch.

FIGS. 5 and 6 show application of the aforedescribed embodiment with a conventional hasp-type latch 39 that includes a pivotally mounted member 41, and a U-shaped arm 43 that fits through slot 45 in the member 41. The application illustrated in FIG. 5 is achieved when lock 11, in open configuration, is fitted over arm 43 which is placed in groove 33, and then urged into its locked configuration. Thus the top wall 47 of lock 11 will lie adjacent the surface of the pivotally mounted member 41. In some circumstances it may be advantageous to secure the latch 39 as shown in FIG. 6 where a front wall 49 of the lock 11 lies adjacent the surface of the pivotally mounted member 41. In this second application the U-shaped member 43 is placed between opposing grooves 31 and 23 of an opened lock 11, which is then closed to grasp member 43 as illustrated. FIGS. 5 and 6 also show that a keyway 51 remains accessible so that lock 11 may be opened and removed when desired.

Figure 11:
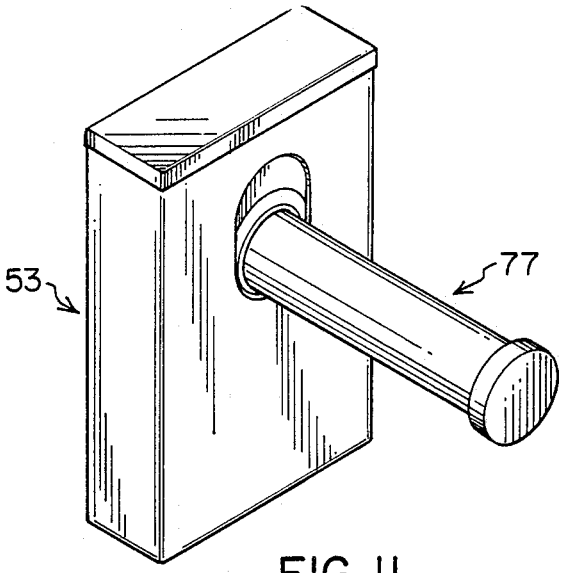
FIG. 11 is a prospective view illustrating the embodiment of FIG. 7 engaging a latching pin.
Figure 8:
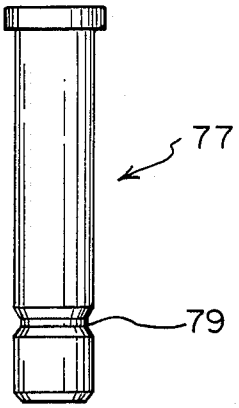
FIG. 8 shows a latching pin used with the device of FIG. 7.
Figure 7:
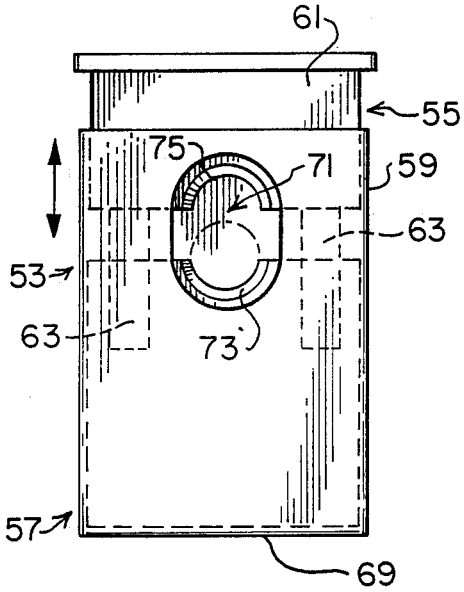
FIG. 7 is a front elevational view of another embodiment of a padlock according to the present invention, in open configuration.
Figure 10:
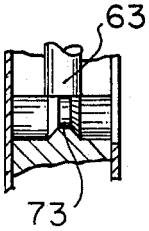
FIG. 10 is a partial sectional view taken along a plane through the line 10—10 of FIG. 9.
Figure 9:
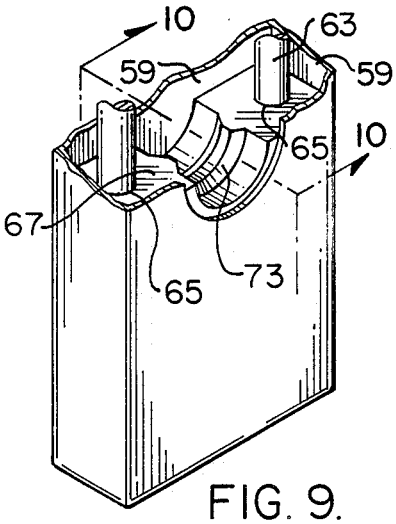
FIG. 9 is a prospective view with parts broken away, of the embodiment shown in FIG. 7.

FIGS. 7 and 11 illustrate another preferred embodiment, in a lock 53 that has a locking head 55 and a main case 57 having upper wall portions 59 that surround and slidably embrace all sides of a recessed wall 61 of the head 55. The upper ends of twin shafts 63 are fixedly attached to the head 55 and their lower ends are received in twin bores 65 in the main case upper wall 67 as illustrated in FIG. 9. The lower ends of shaft 63 make lockable engagement in a conventional manner with locking mechanism within main case 57. The bottom wall 69 is provided with a keyway, not shown, for access to the aforementioned locking mechanism. Note that case 57 is provided with a single vertically elongated opening 71 and that the twin shafts 63 are surrounded and shielded by the upper wall portions 59. This opening 71 provides access, first to a semicircular ridge 73 in the main case upper wall 67, and secondly to a matching semicircular ridge 75, shown in FIG. 7, in the lower wall of the locking head 55. This embodiment 53 is designed to make latching engagement with the circumferentially grooved end of a pin, such as the latching pin 77 shown in FIG. 8. Pin 77 is designed to be placed within opening 71 of a lock 53 that is in open configuration. With the first semicircular ridge 73 aligned with groove 79 of pin 77, the latching head 55 may be urged to a downward position in which shafts 63 are locked and the semicircular ridge 75 engages groove 79 in conjunction with ridge 73 to secure the pin 77 as illustrated in FIG. 11. Lock 53 may be unlocked in the conventional manner and the latching head 55 will shift, under spring force, to the open position of FIG. 7. It is contemplated that a lock 53 may form a latching system with latching members of various configurations, all having in common a pin-like end portion that is circumferentially grooved. For example, in a hasp type latch arrangement otherwise conventional, a peripherally grooved pin-type member can replace the conventional U-shaped arm, the pivotally mounted member having a generally circularly opening for receiving the pin.

Figure 14:
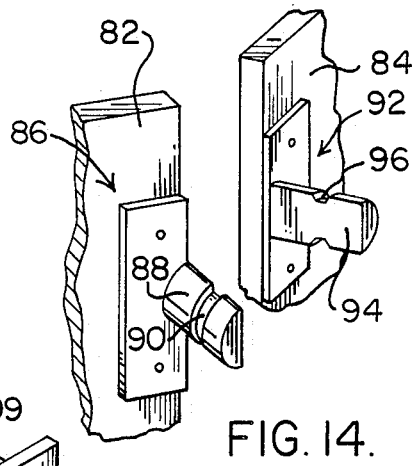
FIG. 14 is a partial view in perspective illustrating a split latching pin for use with the embodiment of FIG. 7.

FIG. 14 illustrates another novel latching system made possible by the lock 53, and which is particularly suitable for securing cabinet doors, and the like, such as the two pivotally mounted doors 82 and 84 partially shown here. Note that the latching fixture here shown has a first component 86 which features a longitudinally split or halved pin 88 with a semicircular groove 90, and a second, complementary component 92 featuring a halved pin 94, with semicircular groove 96. It will be appreciated by those skilled in the art that when components 86 and 92 are brought together, as occurs when doors 82 and 84 are closed, the halved pins 88 and 94 will engage each other and have the form of a singular pin, resembling pin 77 of FIG. 8, which can be secured by lock 53.

Figure 12:
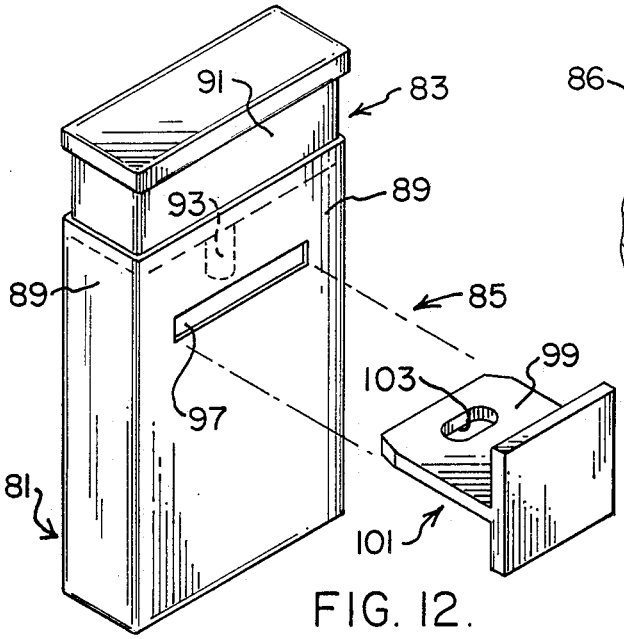
FIG. 12 is a prospective view of still another embodiment according to the invention.
Figure 13:
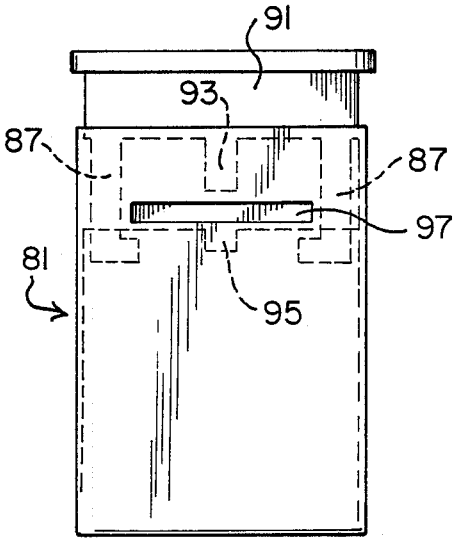
FIG. 13 is a front elevational view of the device of FIG. 12 in open position.
Figure 15:
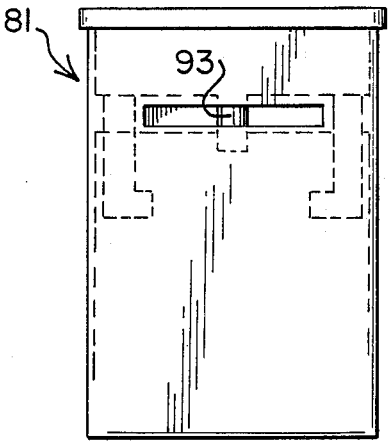
FIG. 15 is a front elevational view similar to FIG. 13, but showing the device in locked configuration.

Still another preferred embodiment according to the present invention is shown in FIGS. 12, 13 and 15 as lock 81, which includes a latching head 83 and main case 85. This embodiment is similar to the previously described one, and has twin shafts 87 and upper main case walls 89 that slidably embrace the recessed wall portion 91 of the latching head 83. This embodiment however, includes a central locking pin 93 that is fixedly attached to the lower wall of the head 83 and depends downwardly therefrom, and the upper wall of the case 85 has a central bore 95, illustrated in FIG. 13, that is aligned below the locking pin 93. When lock 81 is in the open configuration illustrated in FIGS. 12 and 13, the lower end of the pin 93 lies above the level of an elongated rectangular slot 97 in the wall of case 85. This slot 97 is designed to accept the tongue 99 of a latching member 101. Member 101 may be secured when it is inserted in opening 97 and lock 81 is moved to its locked configuration as in FIG. 15, in which pin 93 engages the tongue opening 103 and the central bore 95, and the twin shafts of the locking head are locked within locking mechanism, not shown, within the main case 85. This embodiment 81 may be employed in latching systems using various configurations of latching members, all including a tongue-like engaging member provided with a locking hole.

Preferred embodiments have been described and it should be appreciated by those with ordinary skill in the art, that within the scope of the invention, various changes may be made. Thus it is aimed to cover all changes as fall within the true spirit and scope of the invention.

What is claimed is:

1. Improved padlock for securing a latching member, comprising:

(a) main case having a bottom, spaced-apart side walls and an upper wall with at least one shaft-receiving bore therein, said walls enclosing a locking mechanism, and including portions of said side walls that extend upwardly beyond said case upper wall and that surround said at least one bore, and said upper wall having an upper face providing a first shaped portion for engaging a latching member;

(b) latching head, disposed above said main case, and having at least one shaft-like connecting member fixedly attached to said head and extending from the bottom of said head into said at least one bore to make lockable engagement and limited axial movement therein, said head having outer wall portions that are slidably embraced within said upwardly extending side wall portions of said case for guiding said head in vertical movement relative to said case and for shielding said at least one shaft-like connecting member, and said latching head having a lower face providing a second shaped portion for engaging a latching member;

(c) wherein said padlock has a locked position in which said at least one shaft-like member is locked within said case and said first shaped portion lies in close proximity to said second shaped portion, and said latching head being releasable to an open position in which said first and second shaped portions are spaced apart wherein said first shaped portion is contoured with a first arcuate groove, and a second arcuate groove lies in said second shaped portion, and said first and second grooves adapted to grasp and hold a U-shaped member when said padlock is in locked position, and a third arcuate groove in said second shaped portion, and wherein when said padlock is in locked position, said first, second and third grooves are adapted to grasp and hold a U-shaped member in a first orientation with respect to said padlock in which said first and second arcuate grooves grasp said U-shaped member, or in a second orientation at about 90° to said first orientation in which said third arcuate groove grasps said U-shaped member.

2. Padlock as defined in claim 1 wherein said first and second grooves are oriented at about 90° to said third arcuate groove.

3. Padlock as defined in claim 1 wherein said main case has a generally flat front wall and said latching head has a generally flat top, and said first and second arcuate grooves lie in a plane which is generally perpendicular to said front wall, and said third arcuate groove lies in a plane which is generally perpendicular to said top.

* * * * *